United States Patent [19]

Bokelmann

[11] 4,010,053

[45] Mar. 1, 1977

[54] PROCEDURE FOR THE PRODUCTION OF A HOLLOW BODY OF ROTATION FOR COATING EQUIPMENT

[75] Inventor: Horst Bokelmann, Bad Wildungen, Germany

[73] Assignee: Metzeler Kautschuk AG, Munich, Germany

[22] Filed: Nov. 22, 1974

[21] Appl. No.: 526,384

[30] Foreign Application Priority Data

Nov. 22, 1973 Germany ..... 2358212
May 14, 1974 Germany ..... 7476815

[52] U.S. Cl. ..... 156/154; 29/121.2; 29/127; 29/129; 29/130; 156/171; 156/172; 156/188; 156/191; 156/220; 156/297; 427/359; 427/371; 427/407 C

[51] Int. Cl.[2] ..... B21B 31/08; B31C 1/00; B65H 81/00

[58] Field of Search ..... 156/154, 187, 188, 189, 156/191, 192, 195, 220, 171, 172, 297; 29/121 R, 121.2, 127, 129, 130; 427/359, 371, 407 C

[56] References Cited

UNITED STATES PATENTS

| | | | |
|---|---|---|---|
| 2,723,705 | 11/1955 | Collins | 156/188 |
| 2,729,268 | 1/1956 | Broughton et al. | 156/195 |
| 2,960,753 | 11/1960 | Robertson | 156/187 |
| 3,407,101 | 10/1968 | Lockshaw | 156/220 |
| 3,673,025 | 6/1972 | Fukuyama et al. | 156/154 |
| 3,733,233 | 5/1973 | Griffiths | 156/220 |
| 3,761,338 | 9/1923 | Ungar et al. | 156/220 |
| 3,795,441 | 3/1974 | Hoffman et al. | 29/121 R |

*Primary Examiner*—Charles E. Van Horn
*Assistant Examiner*—Basil J. Lewris
*Attorney, Agent, or Firm*—Armstrong, Nikaido & Wegner

[57] ABSTRACT

A process is provided for the manufacturing of a hollow rotating body which process comprises mounting at least two wheels in a parallel fashion upon a shaft, placing a plurality of strips of glass fiber fabric along the outer circumference of the wheels, whereby an enveloping cylinder is formed, impregnating the strips with plastics or synthetic resins capable of subsequent setting, setting, applying helically layers of impregnated fiber strips tangentially to the cylinder mantle whereby the size of the walls increase, applying a reinforcing belt of wire or tape, applying a finishing coat of plastic or synthetic resin, whereby surface irregularities are smoothed, setting, and mechanically treating the surface to remove irregularities. An apparatus for accomplishing this process is disclosed.

13 Claims, 2 Drawing Figures

PROCEDURE FOR THE PRODUCTION OF A HOLLOW BODY OF ROTATION FOR COATING EQUIPMENT

BACKGROUND OF THE INVENTION

Figure 1:
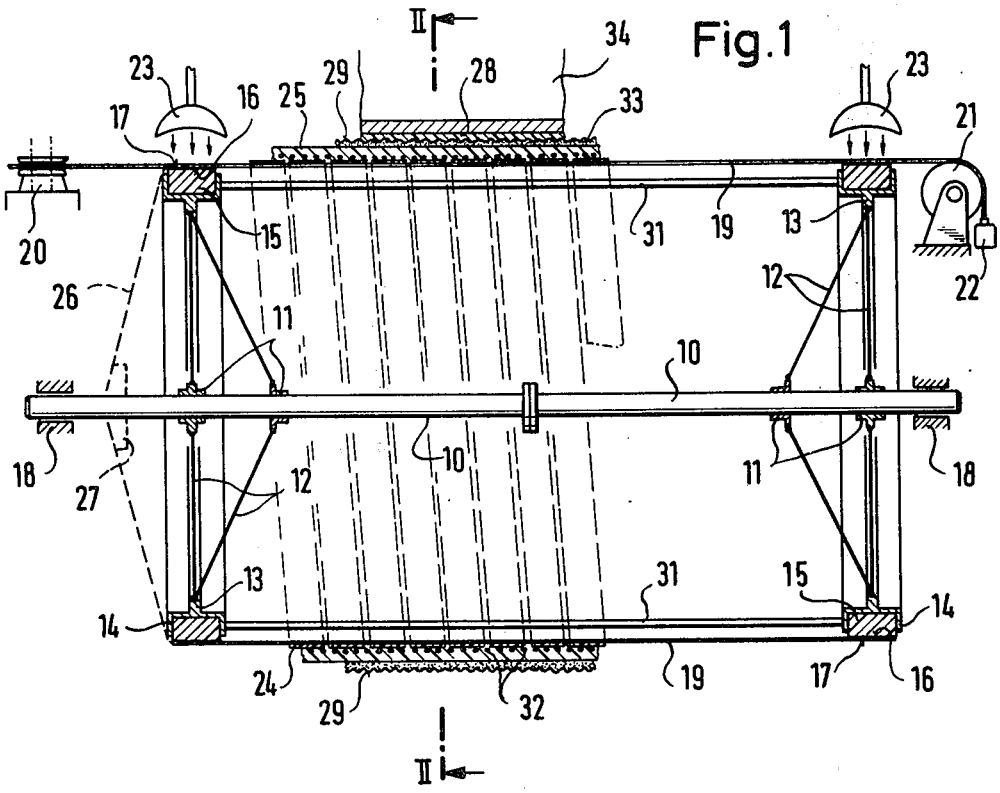

The invention refers to a procedure for the production of a self-supporting hollow body of rotation for processing by way of coating, doubling, dying, cleaning, production or other pertinent processes applied on products having large plane surface areas, such as units or webs of textiles and particularly floor coverings, carpets, woven, knitted or braided goods and furtheron thin sheets, paper, photographic paper, cardboard etc., in consideration of the fact that these hollow bodies of rotation are not suitable for transportation and could not otherwise be manufacturered on known types of machine tools. A known problem in such production units, e.g. for the operation of applying a polyurethane foam backing to floor covering is the fact that a working surface of sufficient width (for instance more than 4 m) and of sufficient length (more than 12 m) must be provided for the coating operation. In known coating units operating according to the expensive and unsatisfactory direct coating procedure, bands made of metals or plastics or of combinations of these materials are used as an endless working surface rotating in similar manner as a conveyor belt. However, it is extraordinarily expensive and very difficult to manufacture such bands in the desired widths and lengths for processing operations of the abovementioned type.

Furthermore this type of operation requires an extremely long working distance, resulting in an uneconomic use of the available floor space of the production facility.

Therefore it is desirable to have a working surface represented by a body of rotation, which can eventually be arranged below ground level in the existing production facility. Incidentally such bodies of rotation having a diameter of possibly more than 5 m cannot be manufactured or respectively processed as a steel roll or the like on the usual machine tools, aside of the fact that such body would become too heavy and unsuitable for transportation due to its dimensions.

The purpose of the invention was to find a possibility for the production of a body of rotation forming a working surface, which would avoid the drawbacks of the known solutions. The invention has solved this task by providing a procedure for the production of a body of rotation, characterized by mounting, as a carrying structure of the body of rotation, directly in the intended position of the production facility at least two wheel tires in parallel distance of and centered arrangement to each other on a shaft, adjoiningly placing a plurality of strips of fibre-glass fabric along the outer circumference of those tires extending approximately in the direction of the longitudinal axis of said shaft until they form an enveloping cylinder, which is then consolidated by impregnation with plastics or synthetic resins capable of subsequent setting, the setting process being followed by helical application of layers of impregnated fibre-glass strips in tangential direction to the cylinder jacket, thus increasing its wall thickness and stiffness, whereupon a reinforcing belt of wire or tape will be applied, followed by a finishing coat of plastics or synthetic resin material upon the cylinder jacket which will compensate any eventual surface irregularities of the strips of fibre-glass fabric and upon subsequent setting this finishing cover will be subjected to mechanical surface treatment.

Further essential aspects of the procedure according to the invention are obvious from the sub-claims contained in the following herein.

Due to the production of the body of rotation immediately at the location of the operating facility or respectively in the area of its subsequent use and due to the choice of the materials for its production — fibre-glass reinforced plastics combined with metal armaments — the costs and efforts of its production are considerably reduced in comparison to the usual figures for metal rolls. In actual utilization of the invention it has moreover proved to be very favourable that the time required for the production of a body of rotation of that type is very short (a few weeks), which makes it possible to produce the body of rotation simultaneously and within the period of assembly of the whole operating unit. This procedure will result in a body of rotation of very light weight, requiring only uncomplicated supports and drives. Aside of that its production will not require specialized experts, it can be accomplished by average skilled labor familiar with the art.

Figure 2:
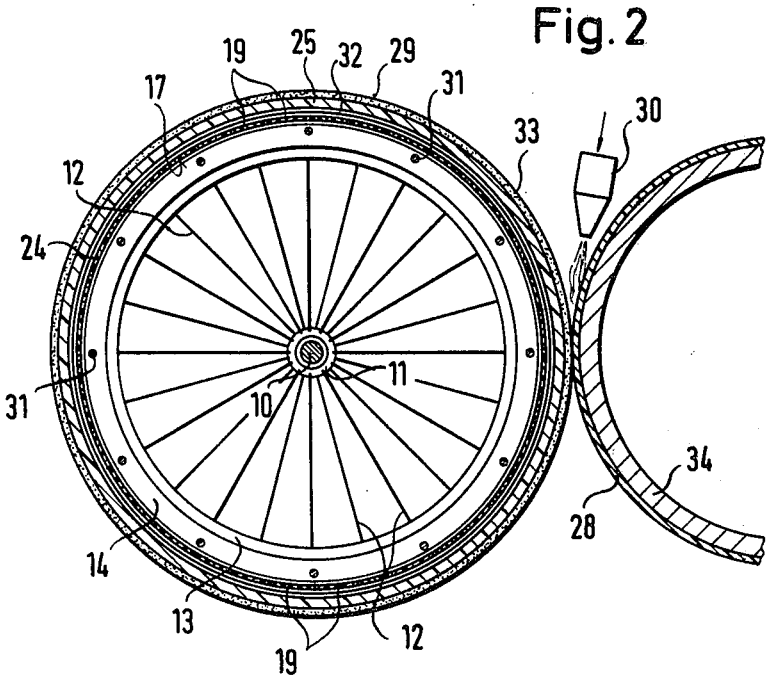

In the following the procedure for the production of such body of rotation will be described with reference to embodiments represented by the attached drawings, wherein FIG. 1 is a view of a longitudinal cut through such body of rotation during its assembly and FIG. 2 is a cross-sectional view of the same body of rotation along the plane II—II.

Upon a shaft 10, consisting of two halves, hubs 11 are fixed, serving as anchoring points for a statically balanced assembly of spokes 12 having their outer ends fixed on annular flanges 13 which are firmly mounted on the bottom side of wheel tires 14, each of the latter being mounted centrally on a shaft 10. Each of the wheel tires will comprise an assembly of individual profile elements of U-shaped cross-section, the legs of the sections pointing outwards and away from the shaft 10. This provides an annular circumferential space similar to the rim base of a vehicle tire, filled up with fibre-glass rovings, plastics, and/or synthetic resins 15. Said filling is smoothed and levelled at the surface area 16 by surface treatment, such as buffing, in a manner resulting in a contact area 17 which is parallel and concentric to the axis of shaft 10.

The two wheel tires 14 with their contact areas 17, rotatably mounted in bearing points 18 on the shaft 10 and eventually equipped for the use of driving means, represent the supporting structure for a body of rotation to be assembled upon them. Said structure is strengthened and stiffened by removable spacing elements 31 arranged parallel to the shaft. As a first step for creating a cylindrical envelope over the wheel tires 14 a plurality of fibre-glass fabric strips 19 is applied parallel to the shaft and so that the strips pass over the contact areas 17 of both wheel tires 14. On one side said strips 19 are clamped in a device 20 and on the other side they are guided over a tensioning device 21 equipped with an adjustable weight 22. Within their zones of contact with the contact areas 17 said strips 19 of fibre-glass fabric are soaked with a plastic material or synthetic resin suitable for setting and adjoiningly they are bonded with the two contact areas. The bonding process can be accelerated by an intensive heating means 23 (infrared).

In this manner one fibre-glass fabric strip 19 after the other is placed, tensioned and bonded, until finally a cylindrical surface is completely enveloping the wheel tires 14. Subsequently this enveloping layer is, as a whole, strengthened and stiffened by soaking with said plastic material or synthetic resin suitable for setting. Eventually several such layers of fibre-glass fabric strips 19 can be superimposed upon each other.

Upon the cylinder surface formed by the strips 19 of fibre-glass fabric further strips 24 of fibre-glass fabric — each of them impregnated with plastic material or synthetic resin suitable for setting — are helically applied, thus gradually increasing the wall thickness, strength and rigidity of said cylinder. The reduction of the diameter in the central area of the resultng cylinder, caused by the great length and by the inevitable sag of the fibre-glass fabric strips 19, is compensated by an onion-skin-like build-up of strips 24 of fibre-glass fabric within this range, so as to obtain a corrected, accurate cylindrical configuration.

The setting process of the plastic material or respectively of the synthetic resin can eventually be accelerated by additional heating during the setting periods. During this setting process or upon its completion a reinforcing belt of helically wrapped or embedded wires or tape 32 is applied in order to obtain a further improvement of the cylinder's form stability.

It has proved convenient to use a spring steel wire of 0.9 mm diameter, placed at a pitch of 7 mm. Of course a steel tape or wires or tapes or materials having similar properties, such as carbon fibres, can be correspondingly used.

Upon the last layer of fibre-glass fabric strips 24 or respectively upon the reinforcing belt of wires 32 a finishing coat 25 of plastic material or synthetic resin is adjoiningly applied in order to compensate surface irregularities and upon its setting this finishing coat is subjected to a mechanical surface treatment, such as buffing. The protruding ends of the fibre-glass fabric strips 19 on both sides of the cylinder can either be trimmed and buffed in the edge zone of the wheel tires 14, or otherwise they can also be pulled inwards following dotted lines 26 and fixed on the shaft 10, resulting in a cylinder with closed end faces having a further improved form stability. In this manner the fixed ends of the fibre-glass fabric strips 19 could contribute towards a partial relief of the spoke assembly 12.

Upon its final treatment the finishing coat 25 already represents a working surface for coating operations, but it can be further improved by the application of another finishing coat 33, which still in its plastic condition is given a preselected surface structure pattern 29 with the help of an embossing roll 34 or of an embossed sheet 28 applied upon a smooth roll. For this embossing process the surface of the embossing roll 34 or respectively of the embossed sheet 28 is conveniently wetted with a release agent 30 so as to avoid the occurrence of any adhesion between the rolls. In actual use the embossed pattern can be changed by buffing of the old pattern and application of a new one.

A further means for the application of a surface pattern on the body of rotation can be provided in a very simple manner by adhering an embossed sheet, which is pulled off again when a change is desired.

It will be convenient to remove the spacing elements 31 on completion of the procedure, because they are needed as stiffeners only during the manufacturing procedure.

What we claim is:

1. A procedure for the production of a self-supporting, hollow body of rotation which can be used for processing by way of coating, doubling, dyeing, cleaning, production or other pertinent processes applied on products having large, plane surface areas, such as units or webs of textiles and particularly of floor covering, carpets, woven, knitted or braided goods and further on thin sheets, paper, photographic paper, cardboard, etc., which body of rotation is not suitable for transportation and which could not otherwise be manufactured on known type of machine tools, which comprises mounting immediately in the intended operating position of the body of rotation wheel tires in parallel distance of and centered arrangement to each other on a shaft; adjoiningly placing a plurality of fiber-glass fabric strips along the outer circumference of said tires and perpendicular thereto so that they extend longitudinally in parallel to said shaft; bonding one end of said strips to the contact surface of the outer circumference of one of the wheel tires; pulling said strips under an adjustable tension over the contact surface of the other wheel tire and then bonding the other end of said strip to the last mentioned contact surface while the tension is maintained, so that the strips form an enveloping cylinder which is only contacted and supported by said wheel tires; consolidating said cylinder by impregnation with plastics or synthetic resins suitable for setting; and upon setting, increasing the wall thickness and stiffness of the cylinder jacket by helical application of layers of impregnated fiber-glass strips which are preferably applied on tangential direction; applying reinforcing belt of wire or tape or of other sections followed by a finishing coat of plastic material or synthetic resin to form an outer skin which will compensate for any irregularities of the fiber-glass fabric strips and of the reinforcing belt; upon subsequent setting subjecting the finishing coat to mechanical surface treatment; and permanently retaining the wheel tires and shaft in the body of rotation.

2. A procedure according to claim 1, characterized by forming and assembling profile sections, into a wheel tire configuration having outer annular spaces similar to the rim base of vehicle tires, filling said annular spaces up with synthetic resins and thereupon applying a mechanical surface treatment in order to obtain contact areas for the adhesion of the ends of fibre-glass fabric strips.

3. A procedure according to claim 1, characterized by mounting the wheel tires on the shaft by means of a stable spoke assembly.

4. A procedure according to claim 1, characterized by stiffening and eventually also reinforcing the wheel tires in their relation on completion of the production procedure.

5. A procedure according to claim 1, characterized by accelerating the adhesion of a strip of fibre-glass fabric on the contact surface by an intensive heating means.

6. A procedure according to claim 1, characterized by the fact that a reduction of the diameter in the central area of the body of rotation, caused by the sag of fibre-glass fabric strips placed parallel to the shaft axis, is compensated through step by step application, in an approximately onion-skin-like buildup of a plurality of helically arranged layers of fibre-glass strips, so as to obtain an accurate surface configuration of a cylinder.

7. A procedure according to claim 1, characterized by using a spring steel wire having a diameter between 0.5 and 2 mm, and a pitch of 7 mm for the helically wrapped reinforcing belt.

8. A procedure according to claim 1, characterized by removing spacing elements arranged between the wheel tires, upon setting of the cylinder jacket.

9. A procedure according to claim 1, characterized by the fact that upon completion of the mechanical surface treatment of the finishing coat another coat of plastic material is applied on the surface of the cylinder jacket and still in its plastic condition is given a surface pattern, by embossed sheets.

10. A body of rotation produced according to the procedure of claim 1, characterized by comprising a supporting structure of two wheel tires fixed in parallel distance of and centered arrangement to each other on a shaft by means of a statically determined spoke assembly and removable spacing elements, a plurality of fibre-glass fabric strips impregnated with plastics materials or respectively with synthetic resins suitable for setting being placed in longitudinal direction of the body over the annular circumferences of the supporting structure, thus forming a cylinder jacket, which is stiffened by a helical arrangement of further impregnated fibre-glass fabric strips and reinforced by a belt of helically wrapped wire, whereupon a finishing cover of plastic material is provided for covering and compensating underlying irregularities, this finishing coat being mechanically smoothened.

11. A body of rotation according to claim 10, characterized by the fact that the wheel tires have a configuration similar to the rim base of a vehicle tire, the hollow space of which is filled up with synthetic resin suitable for setting and upon setting this filling material is treated to form contact surfaces for the fibre-glass fabric strips.

12. A body of rotation according to claim 11, characterized by using a helically wrapped spring steel wire having a diameter between 0.5 and 2 mm at a pitch of 7 mm for the reinforcing belt.

13. A body of rotation according to claim 11, characterized by a further finishing layer of plastic material upon the finishing coat.

* * * * *